US007331576B2

(12) United States Patent
Pelletier et al.

(10) Patent No.: US 7,331,576 B2
(45) Date of Patent: Feb. 19, 2008

(54) FEEDER DEVICE HAVING INCREASED MEDIA CAPACITY AND MULTIPLE MEDIA THICKNESS FEED CAPABILITY AND ASSOCIATED METHOD

(75) Inventors: Joël Pelletier, Saint Sylvain d'Anjou (FR); Sylvain Zumbiehl, Cugand (FR); Olivier Boisdon, Saint-Léger-des-Bois (FR)

(73) Assignee: ZIH Corp., Hamilton (BM)

( * ) Notice: Subject to any disclaimer, the term of this patent is extended or adjusted under 35 U.S.C. 154(b) by 242 days.

(21) Appl. No.: 10/837,903

(22) Filed: May 3, 2004

(65) Prior Publication Data

US 2005/0242487 A1 Nov. 3, 2005

(51) Int. Cl.
*B65H 3/52* (2006.01)

(52) U.S. Cl. ..... 271/124; 271/121; 271/165; 271/10.06; 271/35

(58) Field of Classification Search ..... 271/166, 271/165, 10.03, 35, 150, 245, 124, 121
See application file for complete search history.

(56) References Cited

U.S. PATENT DOCUMENTS

| | | | | |
|---|---|---|---|---|
| 1,394,613 | A | 10/1921 | Drury | |
| RE15,293 | E | 2/1922 | La Bombard | |
| 1,637,833 | A | 8/1927 | Mueller | |
| 1,940,487 | A | 12/1933 | Campbell | |
| 3,578,313 | A | 5/1971 | Eppinger | |
| 3,705,719 | A | 12/1972 | Polit et al. | |
| 3,748,937 | A | 7/1973 | Long | |
| 3,847,382 | A | 11/1974 | McKee | |
| 3,891,203 | A | 6/1975 | Schiff | |
| 3,908,983 | A | 9/1975 | Long | |
| 4,021,032 | A | 5/1977 | Gross et al. | |
| 4,081,181 | A | 3/1978 | Crowe et al. | |
| 4,222,313 | A | 9/1980 | Staufer | |
| 4,330,155 | A | 5/1982 | Richardson et al. | |
| 4,568,074 | A | 2/1986 | Murayoshi | |
| 4,653,742 | A | 3/1987 | Sasaki et al. | |
| 4,718,809 | A * | 1/1988 | Krasuski et al. | 414/797.7 |
| 4,934,685 | A | 6/1990 | Shifley | |

(Continued)

FOREIGN PATENT DOCUMENTS

| | | |
|---|---|---|
| DE | 23 54 107 A1 | 5/1975 |

(Continued)

*Primary Examiner*—Patrick Mackey
*Assistant Examiner*—Kaitlin S Joerger
(74) *Attorney, Agent, or Firm*—Alston & Bird LLP

(57) ABSTRACT

A feeder device is provided, comprising a drive mechanism for driving a media unit in a feed direction, the media unit being provided from a stack of media units by a hopper including upstream and downstream hopper members. A directing member associated with the upstream hopper member engages the trailing edge of the media unit to direct the same to the drive mechanism, reduces an adhesive force between the media unit and remaining media units in the stack, and engages the trailing edge of one other media unit to direct the same toward the downstream hopper member and to partially support the weight of the remaining media units. A biased member urges the media unit against the drive mechanism, thereby increasing a driving force on the media unit, and prevents remaining media units from being fed to the receiving apparatus, also reducing the adhesive force. Associated methods are also provided.

16 Claims, 9 Drawing Sheets

U.S. PATENT DOCUMENTS

| | | | | |
|---|---|---|---|---|
| 4,961,566 | A | | 10/1990 | Labombarde |
| 4,978,115 | A | | 12/1990 | Sato et al. |
| 5,498,123 | A | * | 3/1996 | Alicea ..... 414/797.7 |
| 5,549,200 | A | | 8/1996 | Cowan et al. |
| 5,549,290 | A | | 8/1996 | Long et al. |
| 5,601,282 | A | * | 2/1997 | Milo et al. ..... 271/35 |
| 5,769,408 | A | | 6/1998 | Selak et al. |
| 5,772,199 | A | | 6/1998 | Green |
| 5,906,366 | A | | 5/1999 | Chang |
| 6,050,562 | A | | 4/2000 | Long |
| 6,244,587 | B1 | | 6/2001 | Hermander |
| 6,315,283 | B1 | | 11/2001 | Haas et al. |
| 6,416,047 | B1 | | 7/2002 | Pfankuch |
| 6,431,540 | B1 | | 8/2002 | Lien et al. |
| 6,457,886 | B1 | | 10/2002 | Meier |
| 6,536,758 | B2 | | 3/2003 | Meier et al. |
| 2003/0085508 | A1 | | 5/2003 | Fukuchi |

FOREIGN PATENT DOCUMENTS

| | | | |
|---|---|---|---|
| EP | 0 200 922 | A1 | 11/1986 |
| EP | 0 543 559 | A1 | 5/1993 |
| EP | 0 714 841 | A1 | 6/1996 |
| GB | 2 032 397 | A | 5/1980 |
| JP | 60 087135 | A | 5/1985 |

* cited by examiner

FEEDER DEVICE HAVING INCREASED MEDIA CAPACITY AND MULTIPLE MEDIA THICKNESS FEED CAPABILITY AND ASSOCIATED METHOD

BACKGROUND OF THE INVENTION

1. Field of the Invention

The present invention relates to a feeder device for a receiving apparatus and, more particularly, to a feeder device and associated method for feeding a media unit, the feeder device being capable of feeding multiple thicknesses of media units and having an increased media capacity.

2. Description of Related Art

A printer device such as, for example, a printer as described herein typically includes a feeder for supplying media, such as individual cards, to the printer, a print engine which includes a transport mechanism for transporting the card through the printer and a printing mechanism for printing on the individual cards, and an exit or output hopper for receiving the printed cards. Further, the feeder generally comprises a card hopper for receiving the stack of cards to be fed, in addition to a drive mechanism for feeding the cards to the print engine. A gate at the exit of the feeder, otherwise known as the outlet opening, can include a separation mechanism for separating individual cards, usually an end card, from the stack in order to feed only one card to the print engine at each feed cycle.

Such a card feeder may be used on other card processing systems, such as a patch lamination system, a magnetic card or smart card encoding system, or the like. The drive system generates the driving force for the end card and the separation mechanism generates a separation force on the stack so as to allow the end card to be separated therefrom. With such a card feeder system, a general intent is to provide a driving force on the end card that is greater than the separation force imparted on the stack under many conditions that can exist in the card feeder. The separation force exerted by the separation mechanism on the stack typically has to be greater than a sticking force that can exist between the end card and the remainder of the cards in the stack. This sticking force may be related to, for example, electrostatic discharge ("ESD") between cards, cut or folded card edges, the weight of the stack on the end card, the thickness of the cards in the stack, or other factors or combinations thereof.

In order to address these concerns in a card feeder, a compromise often must be achieved between the separator mechanism, which exerts the separating force on the stack that must be greater than the sticking force between the stack and the end card, and the drive system, which must provide a driving force greater than the separating force, regardless of the type, thickness, condition, and quantity of the cards in the stack. To this end, some previous feeders included, for example, a drive roller acting on the leading edge of the end card for drawing the end card from the card hopper, wherein the card hopper was configured to receive the cards in a uniformly stacked manner, similar to the in-package condition, prior to the cards being fed by the feeder mechanism. However, the drive roller/uniform stack hopper configuration was often unreliable for providing a driving force greater than the sticking force between cards in the stack. Such previous feeders also included, for example, a rigid gate for facilitating separation of the end card from the stack, with the gate being adjustable, in some instances, to correspond to the thickness of the card to be fed. For various reasons, such as ineffectiveness with warped cards or varying thickness among cards, such a rigid gate was a generally unreliable solution. In other instances, such previous feeders included a mechanism associated with the card hopper for adding weight on the cards in the stack, including the end card, for increasing the driving force (or maintaining the driving force at an acceptable level) on the end card when only a few cards remained in the hopper. Such a mechanism, however, often hampered efforts to add more cards to the stack during the printing process.

Some modifications to such previous feeders were also attempted in order to obtain desirable feed conditions for cards in the stack. For example, some feeders included an additional drive roller configured to act on the trailing edge of the card, or varied the shape and/or material comprising the roller(s), in order to increase the driving force on the end card, with respect to the adhesive or sticking force between the end card and the remaining cards in the stack upon initiation of the feeding process. In other instances, the stack of cards was oriented at an angle with respect to the drive mechanism so as to laterally shift adjacent cards to as to reduce the adhesive or sticking force therebetween. In still other instances, the outlet opening included a gate device configured to allow the operative height of the outlet opening to be adjusted according to the thickness of the end card so as to increase the separation force on the remaining cards in the stack. Other modifications implemented a mechanism for maintaining a constant force or weight on the stack of cards regardless of the amount of cards remaining in the hopper. However, such devices remained limited in effectiveness and reliability in instances of card thickness variation within a stack or warped card, or otherwise limited access to the cards remaining in the stack during the feeding process.

Thus, there exists a need for a feeder device capable of supplying media, such as cards, stock, paper, cardboard, etc. to a processing system, such as a print engine, in a secure, reliable, and efficient manner, without such undesirable occurrences as, for example, multi-card feeding or misfeeds, if the hopper is not empty. Such a feeder device should desirably provide effective media feeding for different types of material, for different thicknesses, and for media throughout the stack of media, from the first media unit to last media unit in the stack.

BRIEF SUMMARY OF THE INVENTION

The above and other needs are met by the present invention which, according to one aspect, provides a media unit feeder device adapted to cooperate with a drive mechanism to drive an end media unit in a feed direction, wherein the end media unit has a leading edge and a trailing edge with respect to the feed direction. Such a media unit feeder device comprises a media unit hopper adapted to receive a stack of a plurality of media units and to provide the end media unit to the drive mechanism, wherein the media unit hopper comprises a hopper assembly disposed adjacent to the drive mechanism and having opposing upstream and downstream hopper members with respect to the feed direction and a directing member operably engaged with the upstream hopper member, between the upstream hopper member and the drive mechanism. The directing member is configured to engage the trailing edge of the end media unit so as to direct the end media unit downstream, with respect to the stack, past the downstream hopper member and to the drive mechanism, and is thereby adapted to reduce an adhesive force between the end media unit and media units remaining in the stack in the media unit hopper. A biased member is disposed adjacent to the drive mechanism, downstream of the media unit hopper, and is configured to urge the end media unit against the drive mechanism as the end media unit is fed past the biased member and downstream to a printing apparatus by the drive mechanism. The biased member is thereby adapted to increase a driving force on the end media unit by the drive mechanism. A gate apparatus is disposed adjacent to the drive mechanism downstream of the biased member, and has a flexible blade member operably engaged therewith. The blade member is configured to cooperate with the gate apparatus so as to control a thickness of the media unit capable of being fed to the printing apparatus.

Another aspect of the present invention provides a method of feeding a media unit to a printing apparatus with a media unit feeder device. Such a method comprises driving an end media unit in a feed direction with a drive mechanism, wherein the end media unit has a leading edge and a trailing edge with respect to the feed direction. The end media unit is provided to the drive mechanism from a media unit hopper adapted to receive a stack of a plurality of media units, wherein the media unit hopper has a hopper assembly disposed adjacent to the drive mechanism, and opposing upstream and downstream hopper members with respect to the feed direction. The trailing edge of the end media unit is then engaged with a directing member operably engaged with the upstream hopper member, between the upstream hopper member and the drive mechanism, so as to direct the end media unit downstream, with respect to the stack, past the downstream hopper member and to the drive mechanism, so as to reduce an adhesive force between the end media unit and media units remaining in the stack in the media unit hopper and to provide the end media unit to be driven by the drive mechanism. A driving force on the end media unit by the drive mechanism is increased with a biased member disposed adjacent to the drive mechanism, downstream of the media unit hopper, by urging the end media unit against the drive mechanism with the biased member as the end media unit is fed past the biased member and downstream to the printing apparatus by the drive mechanism. A thickness of the media unit capable of being fed to the printing apparatus is controlled with a gate apparatus having a flexible blade member operably engaged therewith, wherein the gate apparatus is disposed adjacent to the drive mechanism downstream of the biased member.

Aspects of the present invention thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4B:
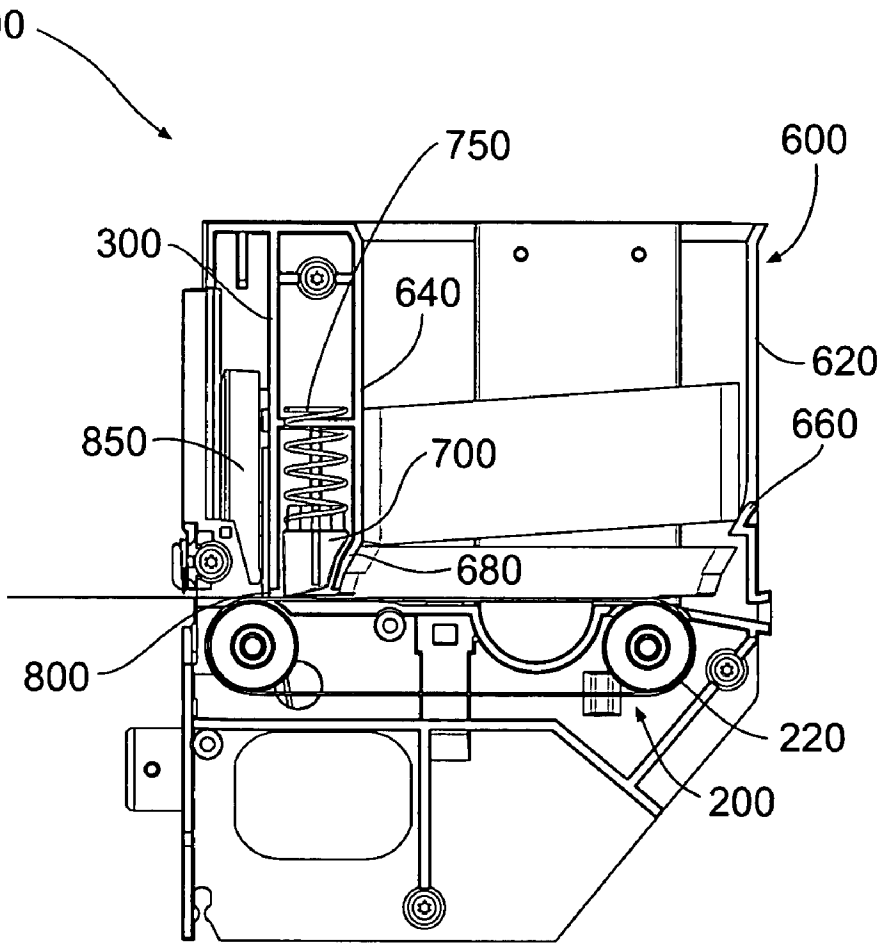
FIGS. 4A and 4B are cut-away perspective and side views of a feed gate apparatus having an adjustably flexible blade according to one embodiment of the present invention.
Figure 4A:
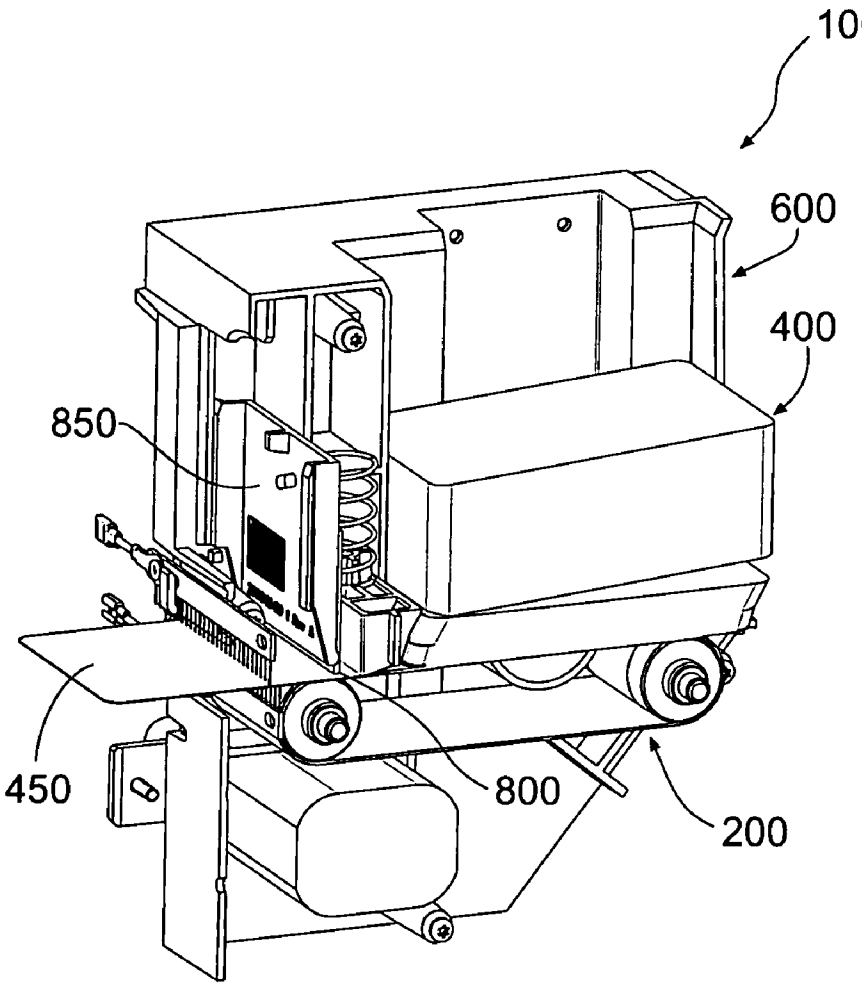
Figures 5A, 5B:
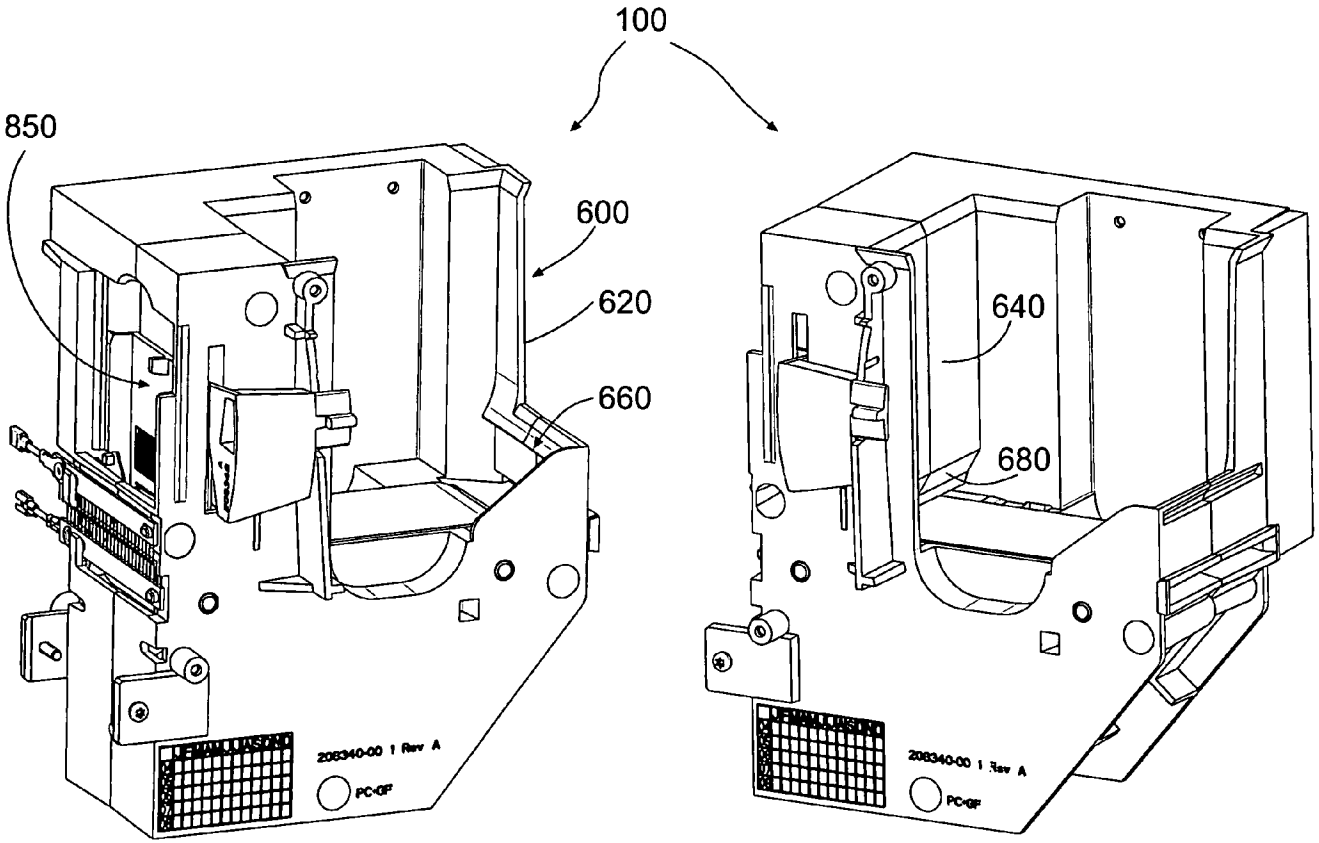
FIGS. 5A-5F are various views of a feed gate apparatus having an adjustably flexible blade according to the embodiment of the present invention shown in FIGS. 4A and 4B.
Figures 5C, 5D:
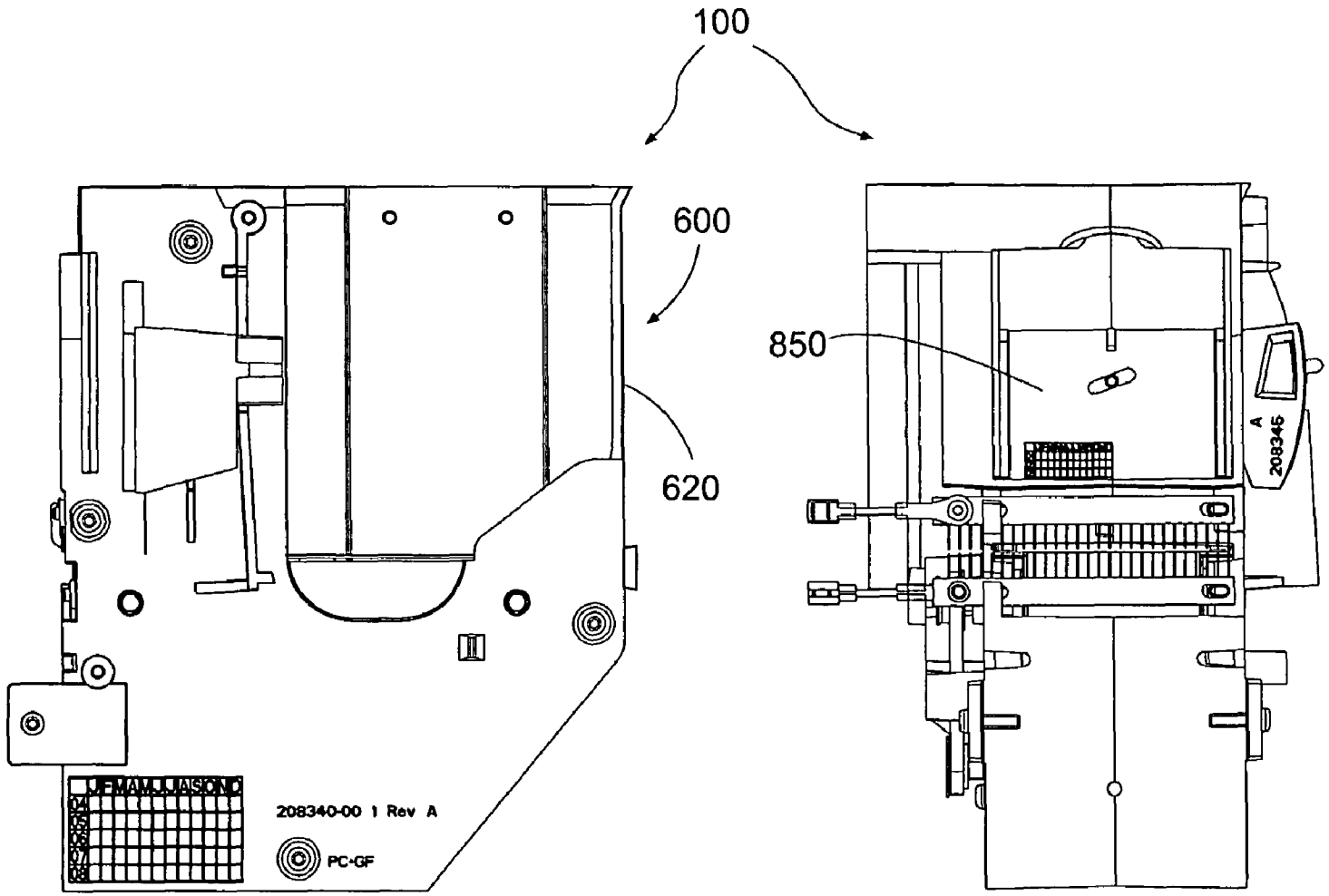
Figure 5F:
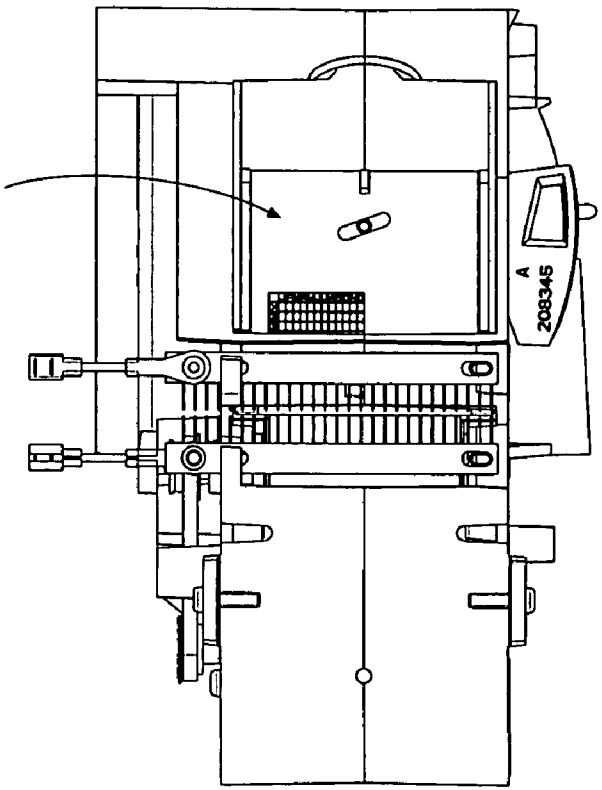
Figure 5E:
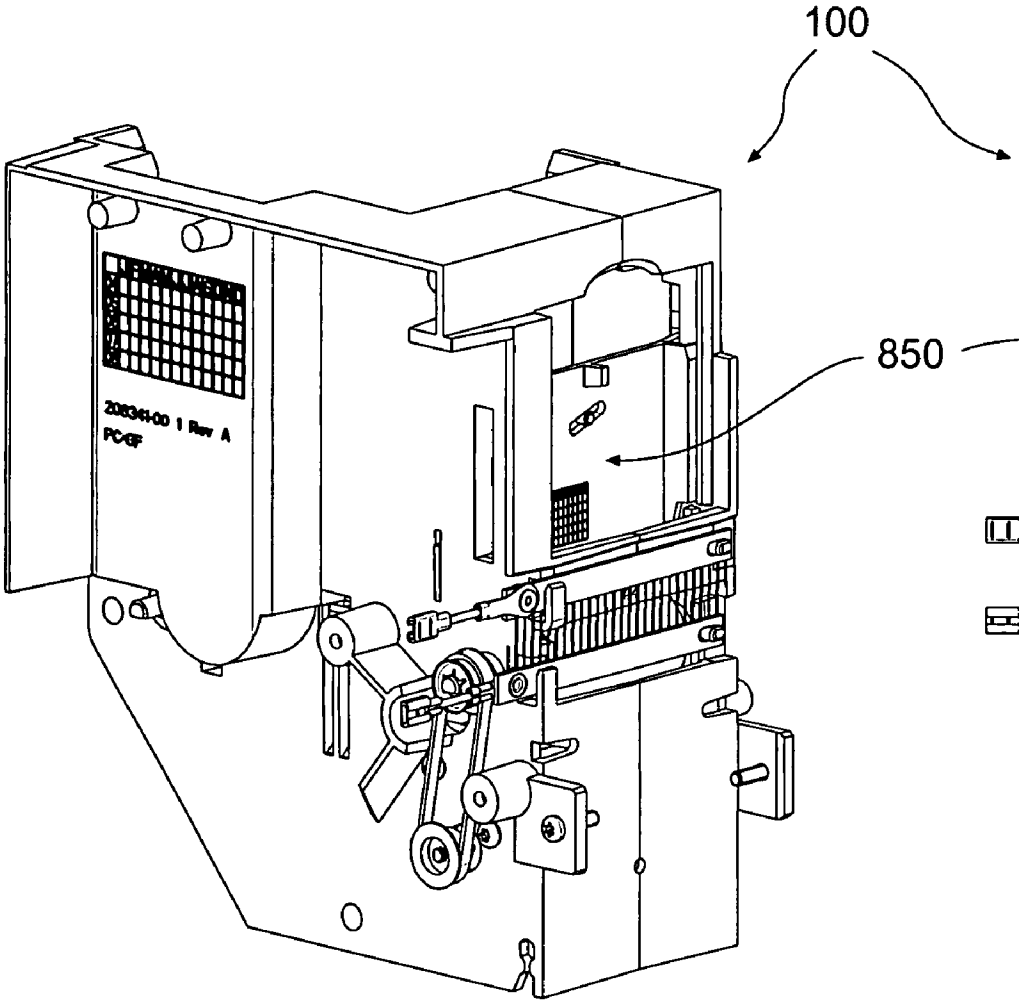
Figure 6A:
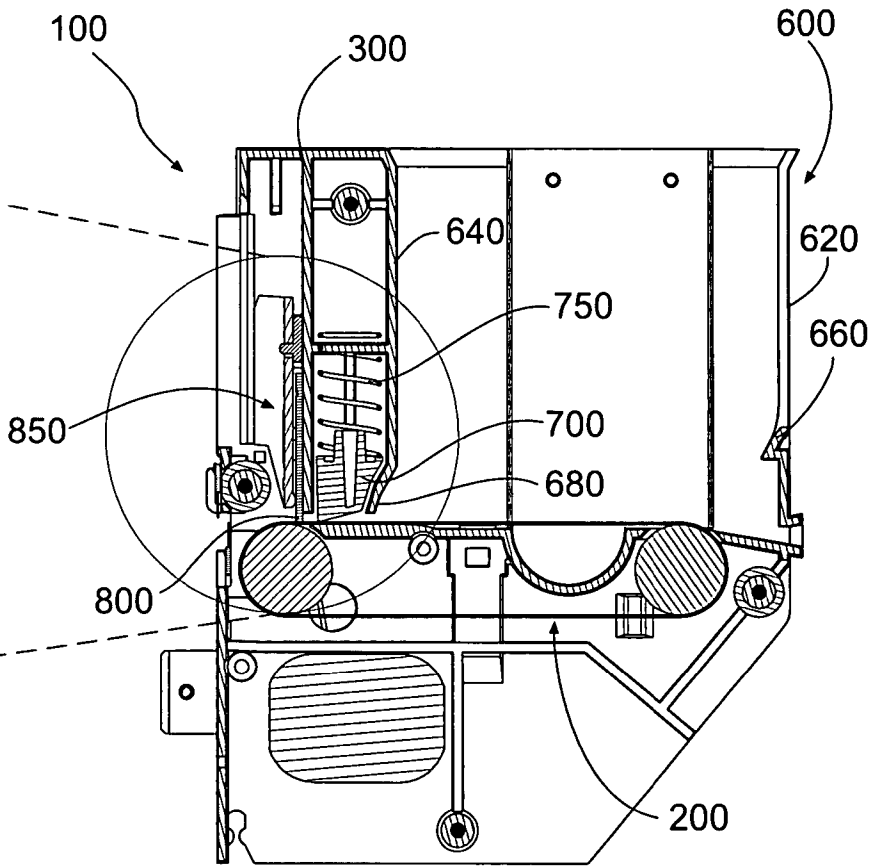
Figure 6B:
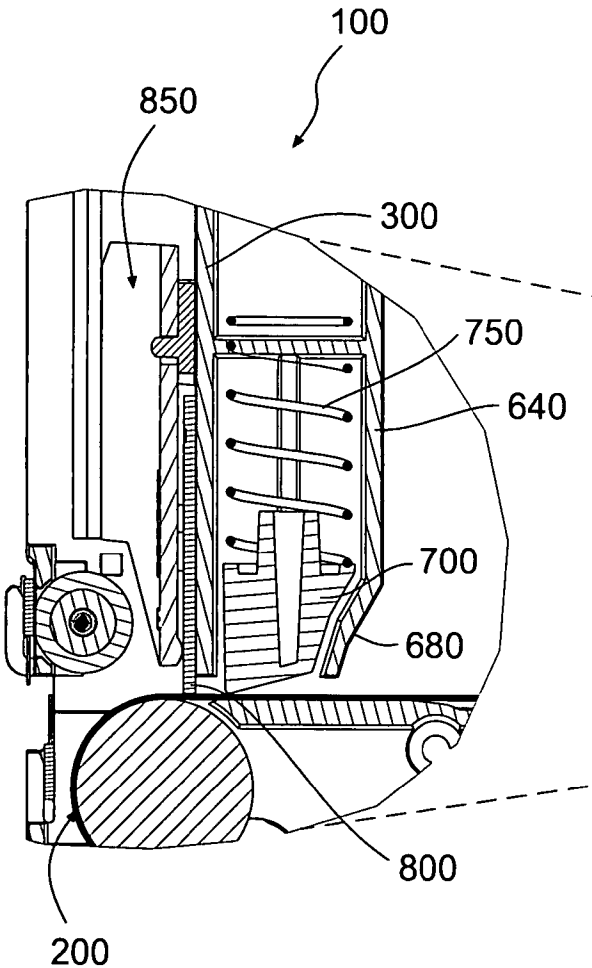
Figure 6C:
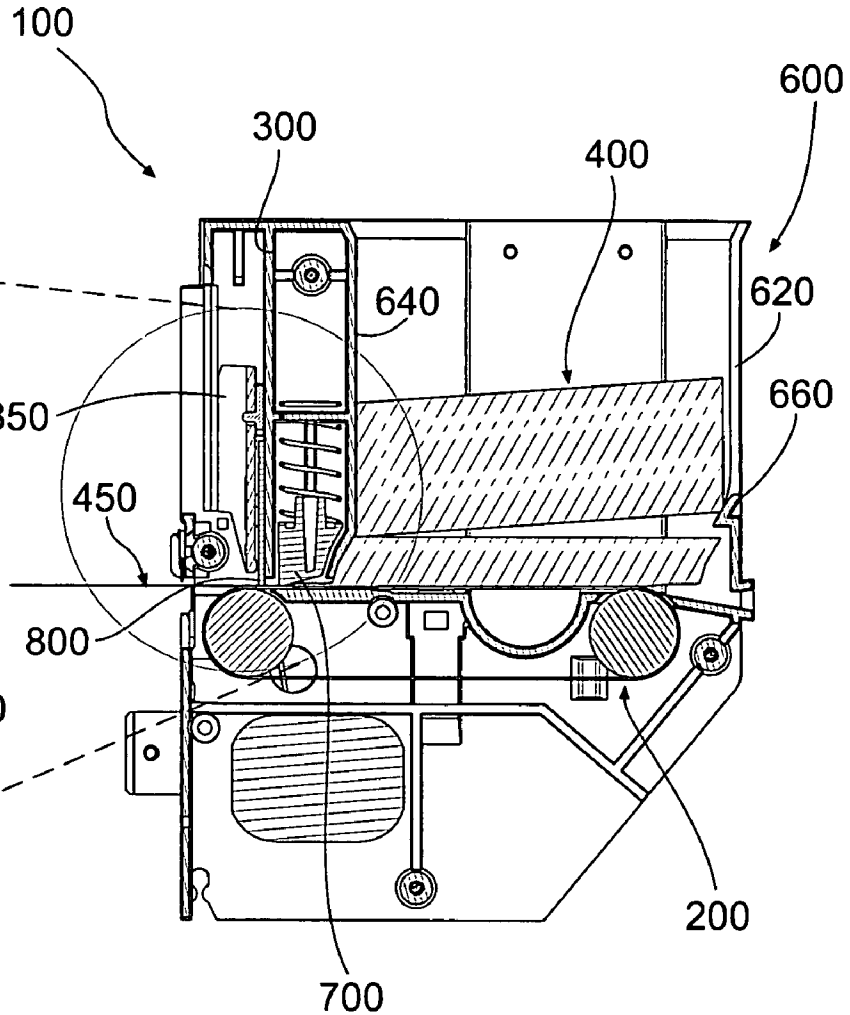
Figure 6D:
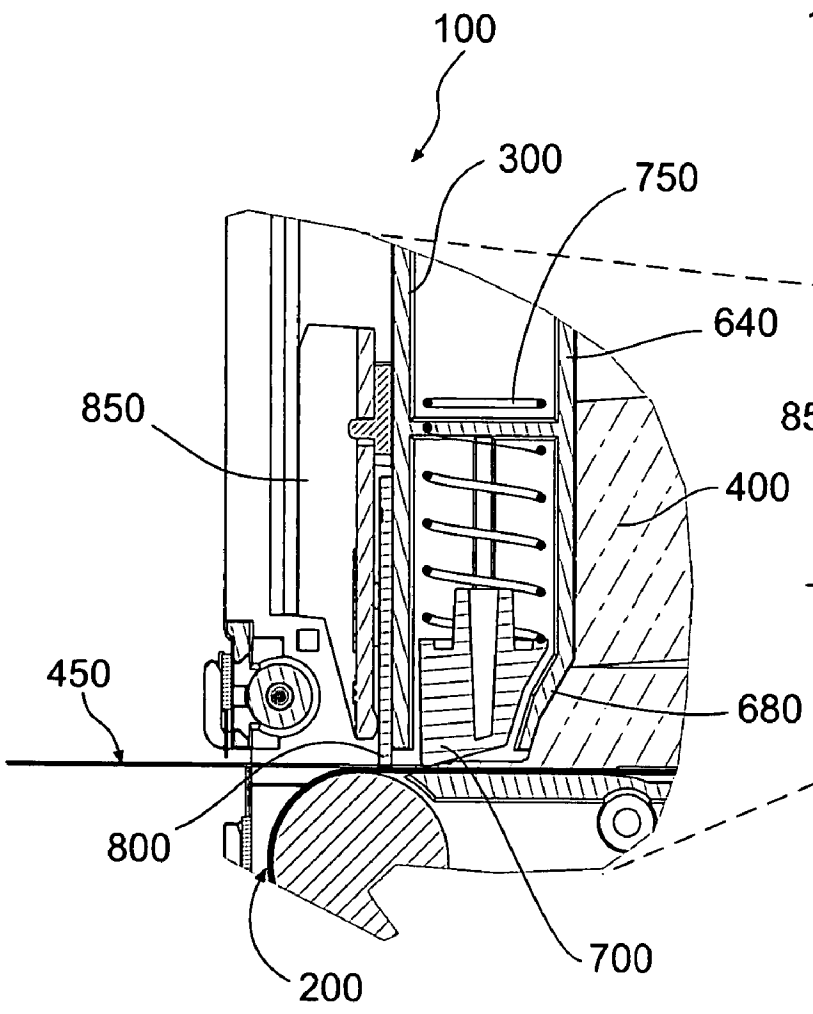

FIGS. 6A and 6B are cross-sectional views of a feed gate apparatus having an adjustably flexible blade according to the embodiment of the present invention shown in FIGS. 4A and 4B; and FIGS. 6C and 6D are cross-sectional views of a feed gate apparatus having an adjustably flexible blade according to the embodiment of the present invention shown in FIGS. 6A and 6B feeding an end card from a stack of cards.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As an initial point, the present invention relates to apparatuses and methods for feeding individual media units from a stack of media units to a receiving apparatus. The disclosure provided below demonstrates use of the apparatuses and methods in a card printer, where the individual media units are cards. It will be understood that the examples of the use of embodiments of the invention provided below should not be seen as limiting the invention to printers and card media. The specific examples herein are merely presented here so as to provide a more complete understanding of the invention and not to limit the scope of the invention. For example, the apparatuses and methods of the present invention can be used in any environment where individual media from a stack of media is provided to a receiving apparatus. Such apparatuses and methods can be used to provide media, such as cards, stock, paper, cardboard, etc. to a printer, to provide labels or other stock material to a production line, etc.

As further detailed herein, one embodiment provides a feeder device adapted to feed a medium, such as card, stock, paper, cardboard, etc. to a receiving apparatus, comprising a drive mechanism adapted to drive an end media unit in a feed direction, wherein the end media unit has a leading edge and a trailing edge with respect to the feed direction. A media unit hopper is adapted to be capable of receiving a stack of a plurality of media units and to provide the end media unit to the drive mechanism. The media unit hopper includes a hopper assembly disposed adjacent to the drive mechanism, wherein the hopper assembly has opposing upstream and downstream hopper members with respect to the feed direction. The media unit hopper further includes a directing member operably engaged with the upstream hopper member, between the upstream hopper member and the drive mechanism. The directing member is configured to engage the trailing edge of the end media unit so as to direct the end media unit downstream, with respect to the stack, past the downstream hopper member and to the drive mechanism. The directing member is thereby adapted to reduce an adhesive force between the end media unit and media units remaining in the stack in the media unit hopper.

Another aspect detailed herein comprises a feeder device adapted to feed a medium, such as card, stock, paper, cardboard, etc. to a receiving apparatus, including a drive mechanism adapted to drive an end media unit, from a stack of a plurality of media units, in a feed direction. A biased member is disposed adjacent to the drive mechanism and is capable of urging the end media unit against the drive mechanism as the end media unit is fed past the biased member and downstream to the receiving apparatus by the drive mechanism. The biased member is further configured to prevent media units remaining in the stack from being fed to the receiving apparatus while the end media unit is being driven by the drive mechanism. The biased member is thereby adapted to increase a driving force on the end media unit by the drive mechanism and to reduce an adhesive force between the end media unit and media units remaining in the stack.

Yet another aspect as detailed herein comprises a method of feeding a medium, such as a card, stock, paper, cardboard, etc. to a receiving apparatus with a media unit feeder device. An end media unit is driven in a feed direction with a drive mechanism, wherein the end media unit has a leading edge and a trailing edge with respect to the feed direction. The end media unit is provided to the drive mechanism from a media unit hopper adapted to be capable of receiving a stack of a plurality of media units. The media unit hopper has a hopper assembly disposed adjacent to the drive mechanism and also has opposing upstream and downstream hopper members with respect to the feed direction. The trailing edge of the end media unit is engaged with a directing member operably engaged with the upstream hopper member, between the upstream hopper member and the drive mechanism, so as to direct the end media unit downstream, with respect to the stack, past the downstream hopper member and to the drive mechanism. The interaction between the directing member and the trailing edge of the end media unit reduces an adhesive force between the end media unit and media units remaining in the stack in the media unit hopper, and serves to provide the end media unit to be driven by the drive mechanism.

Another aspect as detailed herein comprises a method of feeding a medium, such as a card, stock, paper, cardboard, etc. to a receiving apparatus with a media unit feeder device. An end media unit is driven from a stack of a plurality of media units in a feed direction with a drive mechanism. The end media unit is urged against the drive mechanism with a biased member disposed adjacent to the drive mechanism, as the end media unit is fed past the biased member and downstream to the printing apparatus by the drive mechanism. The biased member is configured to prevent media units remaining in the stack from being fed to the receiving apparatus, while the end media unit is being driven by the drive mechanism. A driving force on the end media unit by the drive mechanism is thereby increased and an adhesive force between the end media unit and media units remaining in the stack is reduced.

Embodiments detailed herein thus allow the driving force on the end media unit to be increased which, in turn, allows a more robust separating system to be implemented so as to reduce the sticking force between the end media unit and the other media units in the stack. The effect of the weight of the media unit stack on the end media unit, which is a function of the number of remaining media units in the stack, is reduced, thereby reducing the influence of the remaining media units in the stack on the driving force. Improved access to the stack is also provided, which allows more media units to be loaded or added to the stack even when the feeder is actively feeding media units. A larger stack (additional media units) may also be accommodated. This access to the stack is independent of any mechanism for applying weight on the last few media units of the stack in the media unit hopper area, as the media units in the stack are depleted.

Figure 1:
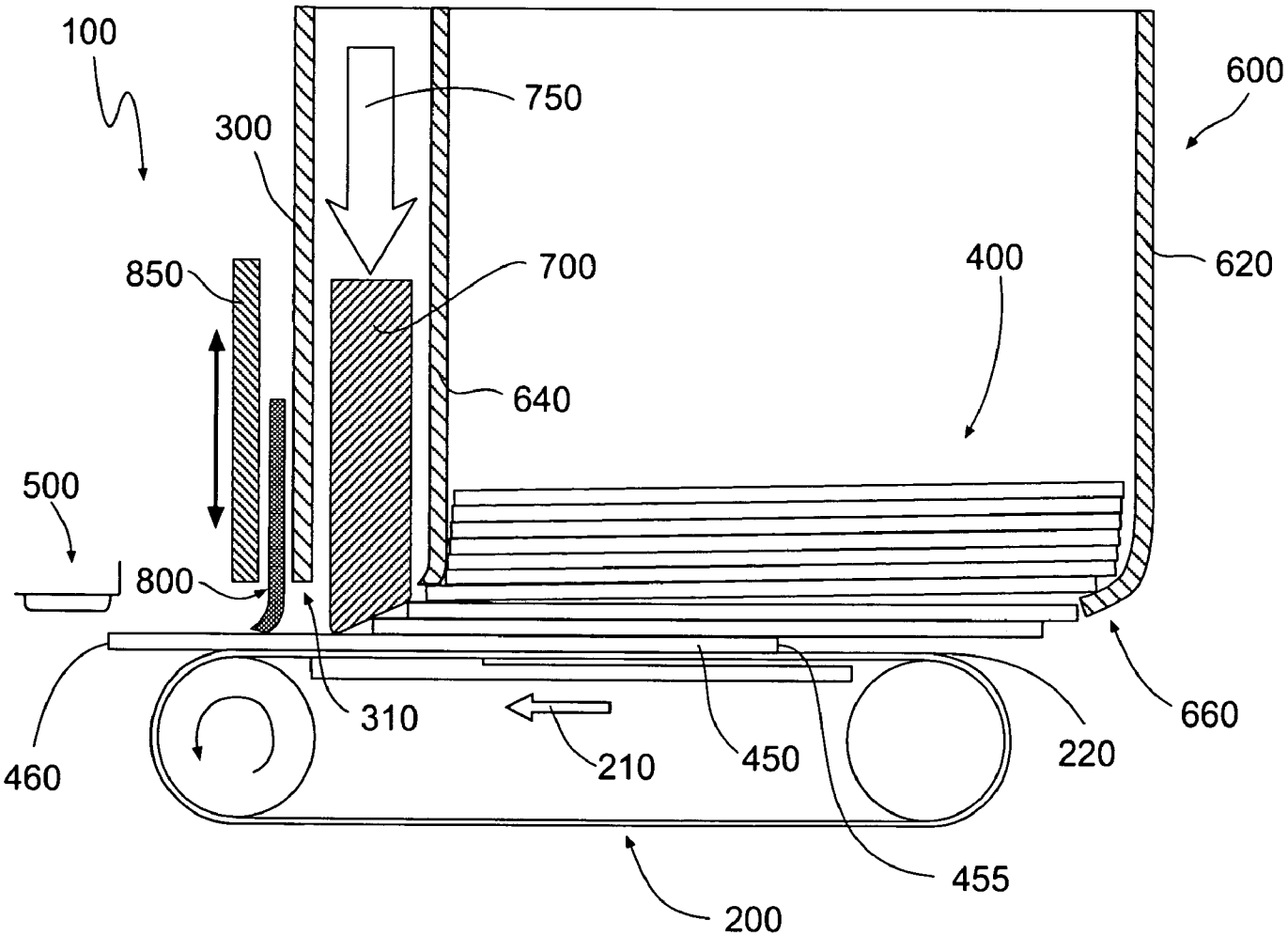
FIG. 1 is schematic of a feeder device capable of effectively feeding media units of varying thickness, while providing for increased media unit capacity, according to one embodiment of the present invention, the feeder device being adapted for use with a receiving apparatus.

FIG. 1 illustrates a feeder device according to one embodiment of the present invention, used to feed cards to a card printer, the feeder device being indicated generally by the numeral 100. The feeder device 100 may comprise, for example, a drive mechanism 200 and a gate apparatus 300. The gate apparatus 300 (otherwise known as or referred to as "the feeder chassis") physically separates or divides a stack of cards or other print medium or media unit 400 from a receiving apparatus such as a print engine or print apparatus 500 configured to produce a print on an end card 450 from the stack 400. The drive mechanism 200 is configured to engage the end card 450, separate the end card 450 from the stack 400, and then feed or drive the end card 450 through an opening 310 defined by the gate apparatus 300. The end card 450 is thus driven through the gate apparatus 300 to the print engine 500 disposed on the opposite side 315 (otherwise referred to herein as the "downstream side" with respect to the feed direction 210 in which the drive mechanism 200 feeds the end card 450) of the gate apparatus 300.

The drive mechanism 200 is configured to provide a driving force for acting on the end card 450 from the stack 400. The driving force may be provided by, for example, a conveyor-type belt, drive roller(s), or other driven friction surface or the like, rotating or otherwise advancing in the feed direction 210 such that contact thereof with the end card 450 causes the driving force to be applied to the end card 450. The driving force thus urges the end card 450 toward the opening 310. In one embodiment, the driving mechanism 200 comprises a conveyor-type belt 220, as shown in FIG. 1, which increases the contact area between the driving mechanism 200 and the end card 450 as compared to, for example, one or more drive rollers and, as a result, may provide an increased and/or more uniform driving force for the card 450. However, one skilled in the art will appreciate that other configurations of a driving mechanism 200 suitable for providing the driving force for the end card 450 may be implemented in the embodiments of the invention as described herein consistent with the described principles and that the conveyor-type belt described herein is but one example. In addition, though the drive mechanism 200 provides the driving force for the end card 450, adjacent cards in the stack 400 typically experience an adhesive or sticking force therebetween. That is, the sticking force between the end card 450 and the next adjacent card in the stack tends to resist the driving force separating the end card 450 from the stack 400. The sticking force can be related to or be the result of, for example, electrostatic discharge ("ESD") between cards, cut or folded card edges, the weight of the stack on the end card, the thickness of the cards in the stack, the material comprising the cards, or other factors or combinations thereof.

Generally, in order to separate the end card 450 from the stack 400, such that only the end card 450 is fed through the opening 310 to the print engine 500, a separating force ($F_{sp}$) is required in opposing relation to the driving force ($F_d$). That is, a separating force must typically be applied at least against the card in the stack 400 that is adjacent to the end card 450, so as to prevent the sticking force ($F_{st}$) from causing the adjacent card to be affected by the driving force and also driven in the feed direction 210. Accordingly, as previously discussed, the separating force is desirably greater than the sticking force so as to prevent feeding of multiple cards toward the print engine 500. However, due to, for example, variations in card thickness or other factors, the separating force, in some instances, may be at least partially applied to the end card 450, as well as the adjacent card in the stack 400. As a result, the separating force should not exceed the driving force because, if the driving force is greater than the separating force, a misfeed or non-feed of the end card 450 may occur.

As shown in FIG. 1, the gate apparatus 300 defines the opening 310 aligned with the drive mechanism 200 and through which end card 450 is fed by the drive mechanism 200 in the feed direction 210. In such a configuration, both the height and the lateral width of the opening 310 are fixed. Preferably, the height of the opening 310 is at least as great as the thickness of the thickest card that is fed by the feeder device 100. In a similar manner, the width is preferably is at least as great as the width of the widest card to be fed by the feeder device 100. For instance, one embodiment of the present invention is particularly configured to feed a card having a length of about 86 mm, a width of about 54 mm, and a thickness of between about 9 mils and about 60 mils, where 1 mil=1/1000 inch. However, such dimensions are provided herein for exemplary purposes only and are not intended in any way to be limiting with respect to the dimensions of a card that may be accommodated by embodiments of a feeder device 100 as described herein. If necessary, the height and width of the opening 310 may be configured to be adjustable to accommodate various card configurations.

Figure 2:
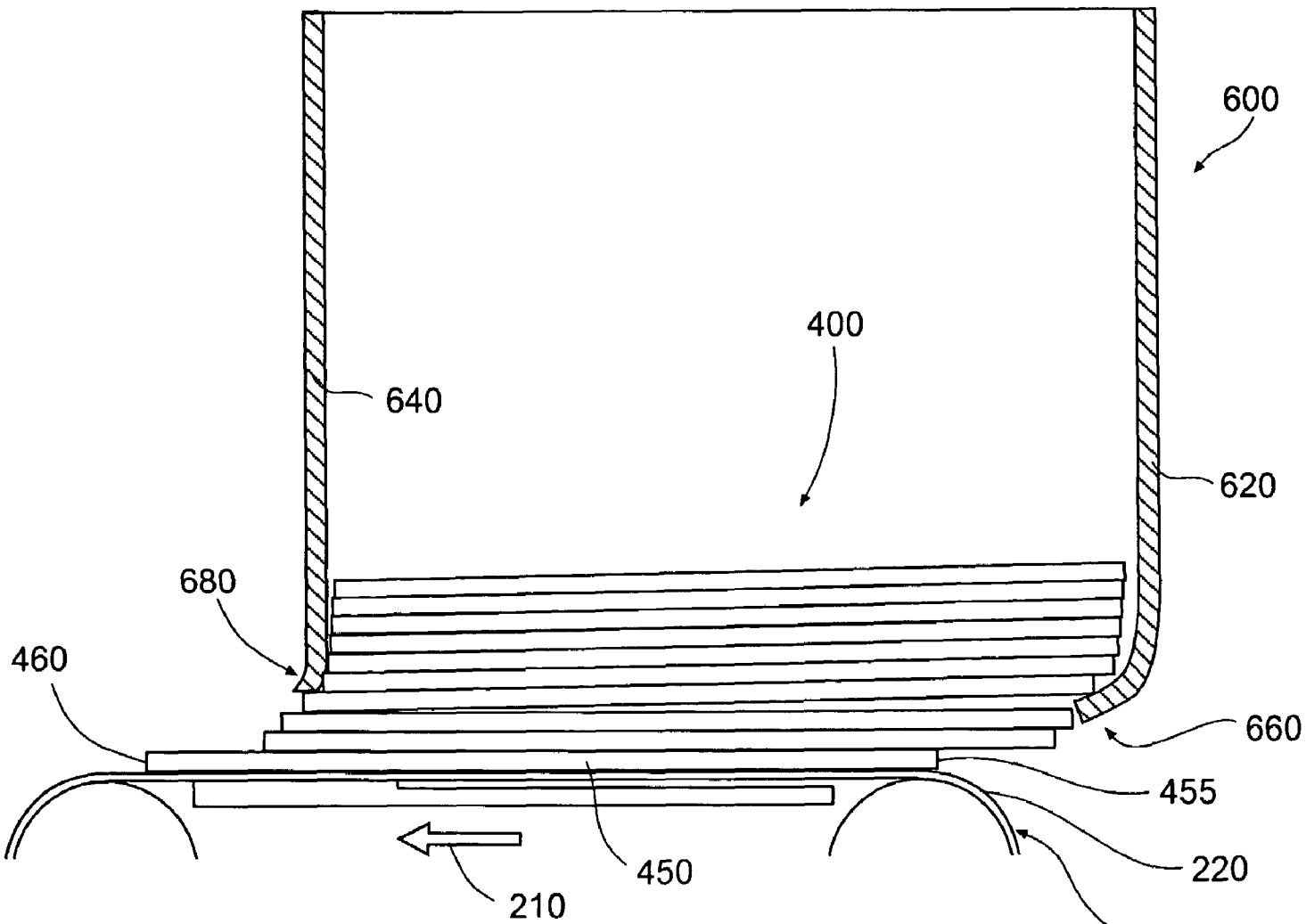
FIG. 2 is a schematic of a hopper assembly component of a feeder device according to one embodiment of the present invention illustrating provisions for increased media unit capacity.

In order to feed the end card 450 from the stack 400 through the opening 310, the drive mechanism 200 must be provided with the end card 450. Accordingly, one embodiment of the present invention, as shown in FIGS. 1 and 2, includes a hopper assembly 600 for receiving and holding the stack 400, wherein the hopper assembly 600 further includes an upstream hopper member 620 and a downstream hopper member 640. More particularly, the hopper assembly 600 is configured to receive the stack 400 between the upstream and downstream hopper members 620, 640. In addition, the hopper assembly 600 is disposed adjacent to the drive mechanism 200, upstream of the gate apparatus 300, and is configured to feed the end card 450 from the stack 400 to the drive mechanism 200. In one embodiment, the drive mechanism 200 comprises a driven friction surface such as, for example, a belt 220 driven such that the surface thereof for contacting the end card 450 proceeds in the downstream or feed direction 210 toward the gate apparatus 300. The belt 220 is configured to provide the driving force on the end card 450. However, in light of the driving force provided by the belt 220, the relationship of driving force ($F_d$)>separating force ($F_{sp}$)>sticking force ($F_{st}$) should desirably be preserved.

Accordingly, one embodiment of the present invention further includes a directing member 660 operably engaged with the upstream hopper member 620 of the hopper assembly 600. The directing member 660 is configured to engage the trailing edge 455 of at least the end card 450 in the stack 400 so as to direct the end card 450 downstream in the feed direction 210 with respect to the stack 400. In this manner, the directing member 660 laterally shifts or "fans" one or more of the cards in the stack 400, including the end card 450, from the general stack orientation in the hopper assembly 600 and in the downstream direction. Fanning of the cards thus reduces the engagement area between the end card 450 and the next adjacent card in the stack 400 and, by reducing the engagement area between cards, the adhesive or sticking force between those cards are also reduced. From another perspective, fanning the cards may be viewed as effectively providing a separation force or, in other instances, may be viewed as lessening the separation force requirement in other downstream processes. The directing member 660 may be formed integrally with the upstream hopper member 620, attached thereto, or otherwise be disposed with respect to the hopper assembly 600 so as to function in the described manner. In one embodiment, the directing member 660 extends from the upstream hopper member 620 toward the belt 220 and the gate apparatus 300. More particularly, the directing member 660 may be configured to slope away from the upstream hopper member 620 and toward the belt 220 in the downstream or feed direction 210. The slope of the directing member 660 may be linear or arcuate, including compound curves or angles, or may be shaped in different manners suitable for accomplishing the described function. In some instances, the material comprising the directing member 660, or any coating applied thereto, may be selected so as to minimize adherence or attraction between the directing member 660 and the cards due to, for example, ESD.

In one embodiment, the directing member 660 is further configured to also interact with at least the card next adjacent to the end card 450 and, in some instances, one or more other cards in the stack 400. In interacting with the trailing edges of the one or more other cards so as to fan those cards in the downstream direction, the directing member 660 may also direct one or more of those other cards toward the downstream hopper member 640. The downstream hopper member 640, in some instances, is configured so as to be spaced apart from the belt 220. In this manner, the leading edge 460 of the end card 450 and, in some instances, the leading edge 460 of at least the next adjacent card, may not sufficiently engage the downstream hopper member 640 so as to be supported thereby above the belt 220. That is, the upstream hopper member 620/directing member 660 engages the trailing edge 455 of the end card 450 so as to direct the end card 450 in the downstream direction. In doing so, the leading edge 460 of the end card 450 is directed toward the downstream hopper member 640 and, as such, the interaction between the leading edge 460 and the downstream hopper member 640 may partially supported the card 450 in the hopper assembly 600 due to, for example, friction between the leading edge 460 and the downstream hopper member 640. However, the leading edge 460 of the end card 450 may not otherwise be supported toward the downstream hopper member 640 and, as such, the leading edge 460 of the end card 450 may tend toward the belt 220 due to, for example, the force of gravity overcoming both the friction between the card and the downstream hopper member 640 and the sticking force between cards.

Depending on the spacing between the downstream hopper member 640 and the belt 220, the next adjacent card in the stack 400, and possibly several other cards directed downstream by the directing member 660, may not be fully supported by both the downstream hopper member 640 and the sticking force between cards and, as such, may also tend toward the belt 220. For those cards, the downstream hopper member 640 may also include a guide member 680 operably engaged therewith for directing and facilitating progress of those cards in the downstream direction. For example, the guide member 680 may be an extension of or otherwise engaged with the downstream hopper member 640 and extending in a direction toward the belt 220 and downstream with respect to the downstream hopper member 640. More particularly, the guide member 680 may be configured to slope away from the downstream hopper member 640 and toward the belt 220 in the downstream direction. The slope of the guide member 680 may be linear or arcuate, including compound curves or angles, or may be shaped in different manners suitable for accomplishing the described function. In some instances, the material comprising the guide member 680, or any coating applied thereto, may be selected so as to minimize adherence or attraction between the guide member 680 and the cards due to, for example, ESD.

With such a configuration of the directing member 660, where the directing member 660 cooperates with the upstream and/or downstream hopper members 620, 640, the leading edges of other cards within the stack 400, in progression away from the end card 450, may be less affected by the force of gravity and, in some instances, may be at least partially supported by other cards in the hopper assembly 600 toward the belt 220, or cards between the hopper assembly 600 and the belt 220. That is, the directing member 660 causes the cards interacting therewith to be directed toward the downstream hopper member 640. This, in turn, causes the cards in the stack 400 to converge toward the downstream hopper member 640 as the end card 450 is fed by the belt 220 and the other cards in the stack 400 progress through the hopper assembly 600 toward the belt 220. The convergence caused by the directing member 660, as well as friction between the leading edges of the cards in the stack 400 and the downstream hopper member 640, and the sticking force between cards, at least partially supports some of the other cards in the stack 400 away from the end card 450. Accordingly, such support may reduce the weight of the stack 400 on the end card 450 and, as a result, may allow the media unit capacity of the hopper assembly 600 to be increased (provide a "high capacity" hopper assembly 600) and may further contribute to reducing the sticking force between the end card 450 and the next adjacent card in the stack 400. From another perspective, the reduction of the stack-weight effect on the end card 450 may be viewed as effectively providing a separation force or, in other instances, may be viewed as lessening the separation force requirement in other downstream processes. Therefore, through reduction of the stack weight on the end card 450 and fanning of the cards prior to providing the end card 450 to the belt 220, interaction and cooperation between the directing member 660 and the downstream hopper member 640 may provide a reduction in the sticking force (or provide a separation force) between the end card 450 and the next adjacent card in the stack 400.

The configuration of the hopper assembly 600 in the described embodiments may reduce the effect of stack weight on the end card 450 and provide for fanning of the cards in the stack, thus reducing the sticking force between cards. However, the advantages may, in some instances, be detrimental with respect to the required driving force on the end card 450 by the belt 220. That is, stack weight and a non-fanned stack 400 may have previously contributed to providing a uniform and sufficient driving force for the end card 450. However, such a configuration was often ineffective when few cards remained in the stack 400 (the weight of only a few cards may have been insufficient to provide the necessary driving force). In such instances, some devices included a mechanism for maintaining a constant weight on the few cards remaining in the stack 400, so as to ensure that an appropriate "stack weight" was maintained on the end card 450. Such mechanisms, on the other hand, tended to be unreliable and, since the remaining cards in the stack 400 were acted upon by the mechanism, often precluded interaction with or adding cards to the remaining cards in the stack 400 until a particular feed process was complete or interrupted. In contrast, embodiments of the present invention further reduce the effect of stack weight on the end card 450 so as to reduce the sticking force between cards.

Figure 3:
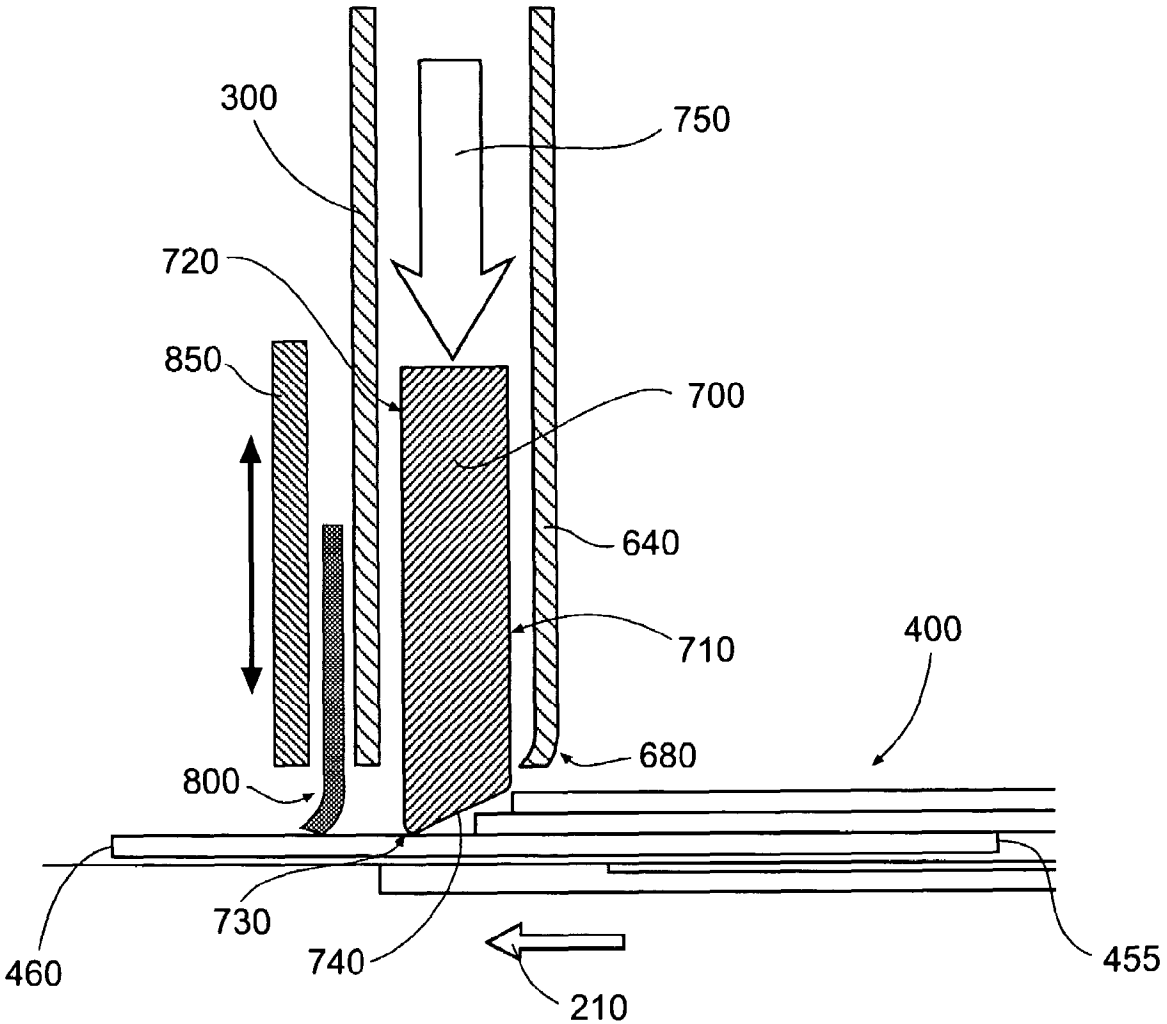
FIG. 3 is a schematic of a biased member component of a feeder device according to one embodiment of the present invention illustrating provisions for effectively feeding media units of varying thickness.

Accordingly, in order to address the reduced stack weight effect, embodiments of the present invention, as shown in FIGS. 1 and 3, further include a biased member 700 disposed adjacent to the drive mechanism 200/belt 220 downstream of the hopper assembly 600. The biased member 700 is configured to engage the leading edge 460 of the end card 450 as the end card 450 is fed downstream from the hopper assembly 600 and/or driven downstream by the belt 220 in the feed direction 210. Once engaged with the leading edge 460 of the end card 450, the biased member 700 is configured to apply a predetermined force to the end card 450, toward the belt 220, so as to, in conjunction with the belt 220, provide an appropriate driving force on the end card 450 or enhance the driving force provided by the belt 220. Since the biased member 700 is disposed in a stationary manner, with respect to the upstream/downstream direction of the feeder device 100, the force imparted by the biased member 700 initially interacts with the leading edge 460 of the end card 450 and progresses along the card 450 to the trailing edge 455 of the card 450, as the end card 450 is driven downstream by the belt 220. As such, the biased member 700, in conjunction with the belt 220, serves to provide a substantially uniform driving force on the end card 450 as the end card 450 is driven from the hopper assembly 600 toward the gate apparatus 300 and the receiving apparatus/print engine 500. The force of the biased member 700 thus acts only on the end card 450 so as to provide an appropriate driving force or to enhance the frictional engagement between the belt 220 and the end card 450 so as to increase the driving force. Accordingly, such an aspect substantially eliminates the need for an independent mechanism acting on the cards in the stack 400 to provide the appropriate stack weight effect for the driving force imparted by the belt 220 on the end card 450. That is, the biased member 700 is configured to provide a substantially consistent force to each end card 450 fed by the belt 220, regardless of how many cards remain in the hopper assembly 600. In addition, since the stack-weight mechanism may be eliminated, embodiments of the present invention further provide a configuration of a hopper assembly 600 wherein the cards or media units contained therein are freely accessible during the feeding process. That is, cards or media units may be added to or removed from the hopper assembly 600 at any time during the feeding process, regardless of how many cards remain in the hopper assembly 600, without affecting the feeding process.

The biased member 700, in one embodiment, has a cross-sectional profile corresponding to a uniaxially tapered wedge extending between an upstream side 710 and a downstream side 720 thereof, wherein the "point" or distal end 730 of the wedge is disposed toward the downstream side 720 of the biased member 700. In one embodiment, the biased member 700 is also configured to be movable toward and away from the belt 220, with the distal end 730 being disposed toward the belt 220. The distal end 730, in one embodiment, is rounded or otherwise arcuately configured. Extending from the distal end 730 to the upstream side 710 of the biased member 700 is an end surface 740 defining the tapered portion of the wedge. The end surface 740 is configured to diverge from the belt 220 when extending from the distal end 730 to the upstream side 710. The end surface 740 may further extend in a linear or arcuate manner toward the upstream side 710, or as a compound curve or angle or other appropriate shape. In one embodiment, for example, the end surface 740 defines an angle of about 70 degrees with respect to the downstream side 720 of the biased member 700 (or an angle of about 20 degrees with respect to the belt 220 when the belt 220 is disposed perpendicularly with respect to the biased member 700), though one skilled in the art will appreciate that such an angle may vary considerably. As shown in FIGS. 1 and 3, the biased member 700 may, in some instances, be configured to move in substantially orthogonal relation to the belt 220.

The biased member 700 is configured to provide the predetermined force against the end card 450, for instance, through its own weight. That is, the weight of the biased member 700 may itself provide the desired force against the end card 450. In other instances, the biased member 700 may include a biasing device 750 operably engaged therewith, wherein such a biasing device 750 may comprise, for example, a spring, an electric actuator, a hydraulic actuator, or other appropriate biasing device or combinations thereof. Accordingly, in an origin or home position, the distal end 730 of the biased member 700 is disposed at a distance from the belt 220 of less than the thickness of the least thick card to be fed. That is, the distal end 730 in the home position is less than the thickness of the thinnest card away from the belt 220. For example, in one instance where the cards to be fed range from between about 9 mils and 60 mils thick, the distal end 730 in the home position may be disposed about 0.1 mm away from the belt 220. The biased member 700 may be made of many different materials wherein, in some instances, it may be advantageous for at least the end surface 740 and the distal end 730 to be comprised of a low friction material. In one example, the biased member 700 is comprised of a polyacetal material, though one skilled in the art will appreciate that many other different materials and/or coatings may also be appropriate.

As a result of the described configuration of this embodiment of a biased member 700, the leading edge 460 of an end card 450 driven by the belt 220 first engages the end surface 740, wherein the convergence of the end surface 740 toward the belt 220 in the downstream or feed direction 210 urges the leading edge 460 of the end card 450 against the belt 220 so as to increase the frictional engagement therebetween. The increased frictional engagement results in an increased driving force that drives the leading edge 460 toward the distal end 730 of the biased member 700. The biased member 700 moves away from the belt 220 when the driving force is sufficient to overcome the force provided by the biased member 700/biasing device 750, so as to allow the card 450 to proceed in the feed direction 210 past the biased device 700. As such, as the belt 220 continues to drive the end card 450 past the distal end 730 of the biased member 700, the biased member 700 imparts the biasing force along the end card 450 via the distal end 730, wherein the biasing force is applied to the end card between the leading edge 460 and the trailing edge 460 as the end card is fed toward the gate apparatus 300 and the receiving apparatus 500.

As previously discussed, the drive mechanism 200 drives the end card 450 toward the opening 310, but other cards in the stack 400 may, in some instances, tend to follow the end card 450 due to, for example, the sticking force between cards. As such, another purpose of the biased member 700, in this regard, is to exert a net separating force on the other cards in the stack 400, greater than the sticking force between cards, so as to allow the end card 450 to be effectively separated from the stack 400. Accordingly, the driving force on the end card 450 as exerted by the belt 220, and the action of the biased member 700, must be greater than the separating force exerted by the biased member 700 on the next adjacent and other cards, such that only the card 450 is fed past the biased member 700 through the gate apparatus 300 and to the receiving apparatus/print engine 500.

Due to the wedge-type configuration of the biased member 700, however, there exists a possibility, in some instances, that the leading edge of more than one card may be urged toward the belt 220 by effect of the end surface 740/distal end 730. As such, in some instances, it may be possible for more than one card to be fed past the biased member 700, where such a condition may be undesirable. More particularly, the feeder device 100 may be configured to feed cards having varying thickness. As a result of varying card thickness, sticking force between cards, and/or other factors, the separating force exerted by the biased member 700 may vary. The biased member 700 may thus have a range of card thicknesses (also referred to herein as "the optimal thickness range") over which the relationship of driving force ($F_d$)>separating force ($F_{sp}$)>sticking force ($F_{st}$) remains valid. If the thickness of the card falls below the optimal thickness range, more than one card may be urged toward the belt 220 by the biased member 700 and the force imparted by biased member 700 may not be sufficient to provide the necessary separating force against the next adjacent and other cards, thereby undesirably increasing the risk of multiple card feeding.

In some embodiments of the present invention, the force imparted by the biased member 700 generally corresponds to the thickness of the card being fed. The force imparted by the biased member 700, for determining the appropriate level or enhancement of the driving force applied to the end card 450 in cooperation with the drive mechanism 200, may be controlled manually, such as through manually adjustment of the compression on the biasing device 750 by the operator of the feeder device 100. Further, the adjustment of the force provided by the biased member 700 may be automatically performed. By using an automatic force determination system for the biased member 700, the apparatuses and methods of the present invention may dynamically adjust to card thickness and thus may be more effective, for example, in instances where the card thickness of the cards in the stack varies. For instance, the apparatuses and methods may adjust to the thickness of a card without operator input. As such, the operator could, in some instances, load a stack having cards of different thickness, with the apparatuses and methods automatically adjusting the force imparted by the biased member 700 to provide or enhance a driving force in conjunction with the drive mechanism 200 commensurate with the thickness of each card.

In other embodiments of the present invention, as shown in FIGS. 1 and 3, the feeder device 100 may farther be provided with an adjustably flexible blade member 800 operably engaged with, for example, the gate apparatus 300 about the opening 310 defined thereby, wherein the flexibility or stiffness of the blade member 800 may be adjusted with an adjusting member 850 such that the stiffness of the blade member 800 corresponds to the thickness of the card being fed. One purpose of the blade member 800, in this regard, is to exert a net separating force on the other cards, in addition to the end card 450, which may be fed past the biased member 700 in some instances. The net separating force exerted by the blade member 800 is generally configured to be greater than the sticking force between cards, so as to allow the end card 450 to be separated from the other cards. Such apparatuses and methods including an adjustably flexible blade member are described in detail, for example, in U.S. patent application Ser. No. 10/837,905, entitled "FEEDER DEVICE HAVING AN ADJUSTABLY FLEXIBLE GATE APPARATUS AND ASSOCIATED METHOD," filed concurrently herewith on May 3, 2004. Accordingly, such a blade member 800 may be provided in addition to the biased member 700 in order to improve the reliability and effectiveness of the feeder device 100 in feeding a card to a receiving apparatus 500 without undesirable occurrences of multiple feeds, misfeeds, or no feeds.

Various views of a feeder device 100 according to one particular embodiment of the present invention are shown in FIGS. 4A, 4B, 5A-5F, and 6A-6D illustrating relative dispositions and interactions of the various elements of and interacting with the feeder device 100 described herein, such as the end card 450, the biased member 700, the drive mechanism 200, the blade member 800, the adjusting member 850, the gate apparatus 300, the hopper assembly 600, and the stack of cards 400. Such elements are not further described here, having already been described elsewhere herein in significant detail.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A media unit feeder device adapted to cooperate with a drive mechanism to drive an end media unit in a feed direction, the end media unit having a leading edge and a trailing edge with respect to the feed direction, said media unit feeder device comprising:

a media unit hopper adapted to receive a stack of a plurality of media units and to provide the end media unit to the drive mechanism, said media unit hopper comprising:

a hopper assembly disposed adjacent to the drive mechanism and having opposing upstream and downstream hopper members with respect to the feed direction; and a directing member operably engaged with the upstream hopper member, between the upstream hopper member and the drive mechanism, the directing member being configured to engage the trailing edge of the end media unit so as to direct the end media unit downstream, with respect to the stack, past the downstream hopper member and to the drive mechanism, the directing member thereby being adapted to reduce an adhesive force between the end media unit and media units remaining in the stack in the media unit hopper;

a biased member disposed adjacent to the drive mechanism, downstream of the media unit hopper, and configured to urge the end media unit against the drive mechanism as the end media unit is fed past the biased member and downstream to a printing apparatus by the drive mechanism, the biased member thereby being adapted to increase a driving force on the end media unit by the drive mechanism; and a gate apparatus disposed adjacent to the drive mechanism downstream of the biased member, the gate apparatus being mounted separately from and being discretely operable with respect to the biased member, the gate apparatus having a flexible blade member operably engaged therewith, the blade member being configured to cooperate with the gate apparatus, separately and discretely of the biased member, so as to control a thickness of the media unit capable of being fed to the printing apparatus.

2. A media unit feeder device according to claim 1 wherein the media units in the stack have a weight associated therewith and the directing member is further configured to engage the trailing edge of at least one other media unit remaining in the stack so as to direct the at least one other media unit toward the downstream hopper member, such that the directing member and the downstream hopper member cooperate to at least partially support the weight of the media units remaining in the stack.

3. A media unit feeder device according to claim 1 wherein the biased member is further configured to prevent media units remaining in the stack from being fed to the printing apparatus while the end media unit is being driven by the drive mechanism, the biased member thereby being adapted to reduce an adhesive force between the end media unit and media units remaining in the stack in the media unit hopper.

4. A media unit feeder device according to claim 1 wherein the biased member is configured to extend between an upstream side and a downstream side, with respect to the feed direction, and includes an end surface extending therebetween and disposed adjacent to the drive mechanism, the end surface being configured to converge toward the drive mechanism as the end surface extends from the upstream side toward the downstream side of the biased member.

5. A media unit feeder device according to claim 4 wherein the biased member further includes an arcuate surface extending between the end surface and the downstream side of the biased member, the arcuate surface being proximally disposed with respect to the drive mechanism.

6. A media unit feeder device according to claim 4 wherein the end surface is further configured to extend from the upstream side toward the downstream side of the biased member according to at least one of a linear relation and an arcuate relation.

7. A media unit feeder device according to claim 4 wherein the end surface defines an angle of about 20 degrees with the drive mechanism.

8. A media unit feeder device according to claim 1 wherein the biased member is configured to be movable toward and away from the drive mechanism, and the media unit feeder device further comprises a biasing device operably engaged with the biased member so as to bias the biased member toward the drive mechanism.

9. A media unit feeder device according to claim 1 wherein the directing member is configured to extend downstream from the upstream hopper member so as to converge toward the drive mechanism.

10. A media unit feeder device according to claim 9 wherein the directing member is configured to extend downstream from the upstream hopper member according to at least one of a linear relation and an arcuate relation.

11. A media unit feeder device according to claim 1 wherein the downstream hopper member further comprises a guide member, the guide member being configured to cooperate with the directing member so as to direct the end media unit downstream with respect to the stack.

12. A method of feeding a media unit to a printing apparatus with a media unit feeder device, said method comprising:

driving an end media unit in a feed direction with a drive mechanism, the end media unit having a leading edge and a trailing edge with respect to the feed direction, the end media unit being provided to the drive mechanism from a media unit hopper adapted to receive a stack of a plurality of media units, the media unit hopper having a hopper assembly disposed adjacent to the drive mechanism and having opposing upstream and downstream hopper members with respect to the feed direction;

engaging the trailing edge of the end media unit with a directing member operably engaged with the upstream hopper member, between the upstream hopper member and the drive mechanism, so as to direct the end media unit downstream, with respect to the stack, past the downstream hopper member and to the drive mechanism so as to reduce an adhesive force between the end media unit and media units remaining in the stack in the media unit hopper and provide the end media unit to be driven by the drive mechanism;

increasing a driving force on the end media unit by the drive mechanism with a biased member disposed adjacent to the drive mechanism, downstream of the media unit hopper, by urging the end media unit against the drive mechanism with the biased member as the end media unit is fed past the biased member and downstream to the printing apparatus by the drive mechanism; and controlling a thickness of the media unit capable of being fed to the printing apparatus with a gate apparatus having a flexible blade member operably engaged therewith separately and discretely of the biased member, the gate apparatus being disposed adjacent to the drive mechanism downstream of the biased member, and the gate apparatus being mounted separately from and being discretely operable with respect to the biased member.

13. A method according to claim 12 wherein the media units in the stack have a weight associated therewith and engaging the trailing edge of the end media unit further comprises engaging the trailing edge of at least one other media unit remaining in the stack with the directing member so as to direct the at least one other media unit toward the downstream hopper member, such that the directing member and the downstream hopper member cooperate to at least partially support the weight of the media units remaining in the stack.

14. A method according to claim 12 further comprising reducing an adhesive force between the end media unit and media units remaining in the stack in the media unit hopper by preventing media units remaining in the stack from being fed to the printing apparatus with the biased member while the end media unit is being driven by the drive mechanism.

15. A method according to claim 12 wherein the biased member is movable with respect to the drive mechanism and the method further comprises biasing the biased member toward the drive mechanism with a biasing device operably engaged with the biased member.

16. A method according to claim 12 further comprising directing the end media unit downstream with respect to the stack, with a guide member operably engaged with the downstream hopper member, in cooperation with the directing member.

* * * * *